US012758859B2

(12) United States Patent
Berthold

(10) Patent No.: US 12,758,859 B2
(45) Date of Patent: Oct. 13, 2026

(54) STRATEGIC FOSSIL QUEST BOARD GAME

(71) Applicant: David Berthold, East Hartford, CT (US)

(72) Inventor: David Berthold, East Hartford, CT (US)

( * ) Notice: Subject to any disclaimer, the term of this patent is extended or adjusted under 35 U.S.C. 154(b) by 150 days.

(21) Appl. No.: 18/960,158

(22) Filed: Nov. 26, 2024

(65) Prior Publication Data

US 2026/0145052 A1 May 28, 2026

(51) Int. Cl.
*A63F 3/04* (2006.01)
*A63F 3/00* (2006.01)

(52) U.S. Cl.
CPC ..... *A63F 3/0449* (2013.01); *A63F 3/00574* (2013.01); *A63F 2003/0455* (2013.01)

(58) Field of Classification Search
CPC ..... A63F 3/0449; A63F 3/00574; A63F 2003/0455
See application file for complete search history.

(56) References Cited

U.S. PATENT DOCUMENTS 2,409,493 A * 10/1946 Jones ..... A63F 3/0695 273/281
3,002,491 A * 10/1961 Bachman ..... A63F 3/0695 273/281
2024/0416219 A1* 12/2024 Chen ..... A63F 9/0807
2025/0177849 A1* 6/2025 Halgren ..... A63F 3/00075

* cited by examiner

*Primary Examiner* — William Boddie
(74) *Attorney, Agent, or Firm* — Ashley D. Johnson; Dogwood Patent and Trademark Law

(57) ABSTRACT

The invention is a board game and associated method for playing a board game. The board game includes a playing surface configured as an excavation site. Specifically, the game includes a frame that surrounds a grid, and a plurality of double-sided tiles that cooperate with the frame and grid. Users roll a pair of dice to select specific grid tiles to attempt to remove. Once a tile is successfully removed, it can be collected or placed on the puzzle board, depending on what type of tile it is.

15 Claims, 19 Drawing Sheets

STRATEGIC FOSSIL QUEST BOARD GAME

TECHNICAL FIELD

The presently disclosed subject matter relates to a strategic board game that includes interactive archeological-themed challenges to provide entertainment and learning skills to players.

BACKGROUND

Board games have been routinely played throughout the United States for many years. To this end, strategic board games are known in the art, and many have proven entertaining to play. Much of the enjoyment of the games is derived from a sense of competition and overcoming obstacles, and that a superior strategy can translate into a faster player winning the game. For many, the enjoyment of one game over another corresponds to the extent that the layout of the board and any associated playing pieces combined with movement and strategies to win the game. In modern times, games such as Monopoly® have been consistently popular over a long period of time. In Monopoly® and other conventional games, playing pieces are moved around a game board using dice and cards in an effort to amass the most money and win the game. However, the noted prior art games typically take hours to win because players attempt to erect structures on captured property using earned money. Due to the long playing periods and monotony of prior art games, it would be beneficial to provide a unique archeological themed board game that offers a challenging method of play. As such, the more realistic and exciting a board game, the enjoyment level of play will be greater. It would therefore be beneficial to provide a new board game for players that increases entertainment during play as well as promotes strategy learning.

SUMMARY

The presently disclosed subject matter is directed to a new, unique, and entertaining board game.

In some embodiments, the presently disclosed subject matter is directed to a game for one or more players. Particularly, the game comprises a frame defined by a plurality of frame legs that interconnect together, creating an open interior. Each frame leg comprises a plurality of channels that extend from a front face to a rear face of each frame leg. The game includes a grid defined by a plurality of segments that intersect to create a plurality of squares, wherein each segment includes a first overhang at a first end of the segment and a second overhang at a second end of the segment. Each overhang is configured to fit within a corresponding channel. Each square includes a pair of opposed rails that partially extend along two opposites sides of each square and each rail includes one rounded end. The game includes a plurality of tiles, each tile comprising a first side and an opposed second side with a unique graphic element. The game includes one or more puzzle boards, each puzzle board comprising one or more spaces configured for the insertion of one or more tiles. The frame legs are selected from a first pair of frame legs and a second pair of frame legs, wherein each of the first pair of frame legs comprises an arm extending from a first and second end of each of the first pair of frame legs, and wherein each of the first pair of frame legs comprises a protrusion at the first and second end of each of the first pair of frame legs. The second pair of frame legs each include cutouts at a first and second end of each of the second pair of frame legs, the cutouts configured to allow insertion of the arm into the cutouts to releasably connect adjacent frame legs together, and wherein each of the second pair of frame legs comprise an aperture at the first and second end of each of the second pair of frame legs, each aperture configured to house a protrusion. Each grid overhang has the same length except one overhang at one end of a segment that is shorter than the remaining overhang. Each frame channel has the same length except one frame channel that is configured shorter than the remaining channels. The shorter segment overhang is configured to align with and fit into the shorter frame leg channel.

In some embodiments, the game further includes a pair of dice and one or more scorebooks.

In some embodiments, the frame leg channels extend uniformly along a bottom surface length of each frame leg.

In some embodiments, each of the first pair of frame legs comprise one or more clips that cooperate with notches positioned in the grid to join the frame leg and grid together.

In some embodiments, the frame is configured in a rectangular or square shape with an open interior.

In some embodiments, the frame includes horizontal and vertical identifiers that identify each of a plurality of rows and each of a plurality of columns of the grid.

In some embodiments, the grid is configured to fit within the open interior of the assembled frame.

In some embodiments, each tile is sized and shaped to fit into a corresponding grid square.

In some embodiments, the assembled frame has a length and width of about 10-15 inches and a thickness of about 0.5-2 inches.

In some embodiments, the presently disclosed subject matter is directed to a method of playing the disclosed game. Specifically, the method comprises assembling the frame legs to form a square or rectangular shape with an open interior. The method includes positioning the grid within the open interior of the assembled frame, wherein each grid segment overhang is accommodated within a frame leg channel. The method includes positioning the plurality of game tiles within the grid, wherein each tile is placed with a first side facing up in a corresponding grid square. The method includes rolling a pair of dice, wherein the numbers rolled on each die correspond to a row and column of grid to identify a target square, whereby a player attempts to remove a tile present in the target square by tapping along one edge of the square such that the square either remains or falls through the square. When the tile falls through the square, the player retrieves the tile, adds the point value indicated on the tile to their score card, and either adds it to the corresponding space of the puzzle board, or else retains it if the tile is not part of the corresponding puzzle board. Different sets of tiles are used with different puzzles, as described below.

In some embodiments, the two dice are each a different color relative to each other.

In some embodiments, points are awarded when a tile is removed from a square.

In some embodiments, the player with the most accumulated points at the end of the game is the winner.

In some embodiments, the game ends when the puzzle board is completed by filling in all empty spaces with a corresponding tile to create an image.

In some embodiments, the game ends when no tiles are moved from the grid for two consecutive turns of all players.

DETAILED DESCRIPTION

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

Figure 1:
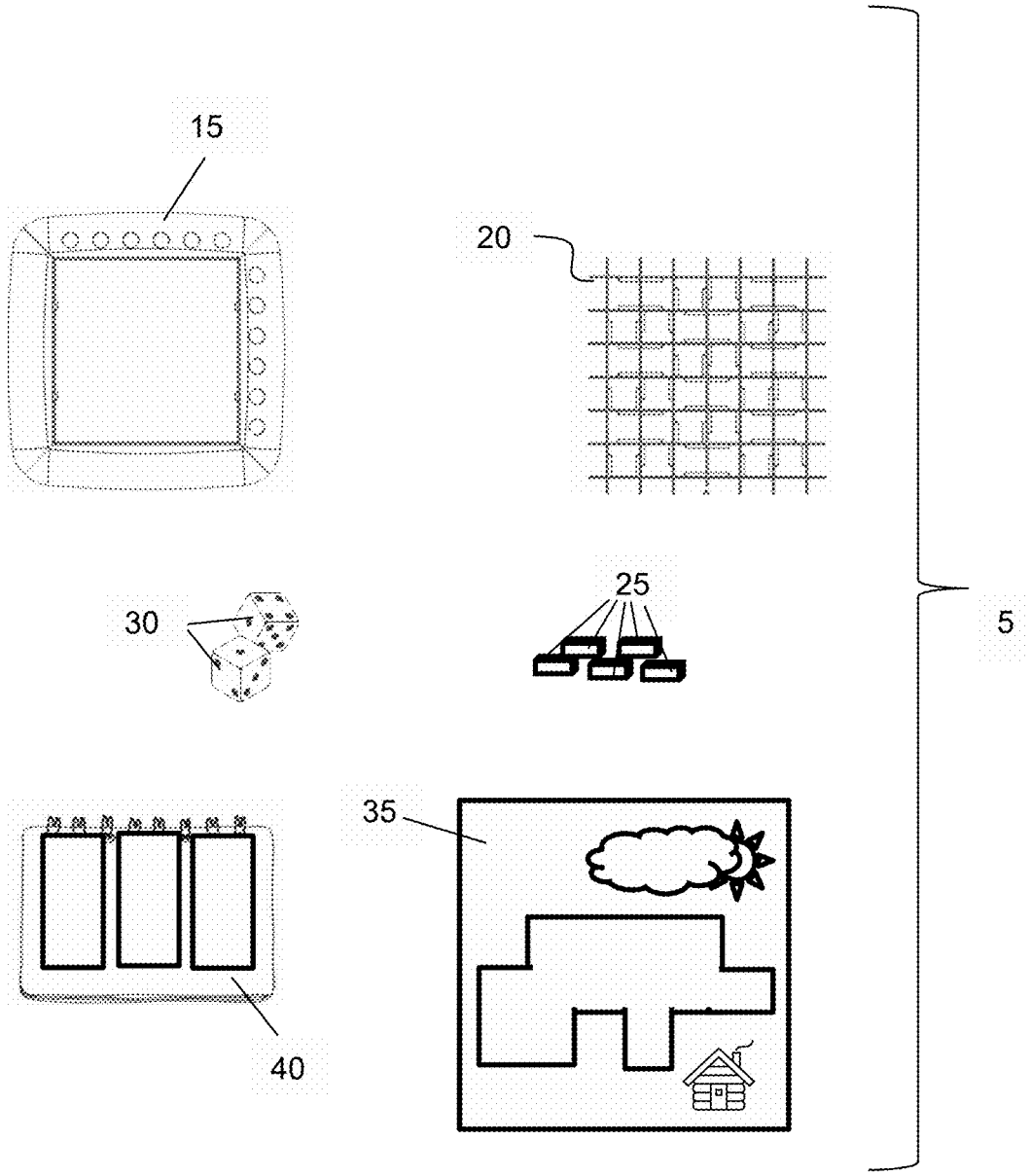
FIG. 1 is an exploded view of a game comprising a frame, a grid, a plurality of tiles, one or more puzzle boards, a pair of dice, and a scorebook in accordance with some embodiments of the presently disclosed subject matter.

The presently disclosed subject matter is directed to a unique and entertaining game and an associated method for playing the game. The term "game" as used herein broadly refers to a game played according to a set of rules where players participate in game competition using a playing surface in addition to a plurality of accessories. As shown in FIG. 1, game 5 can be configured as an excavation site. Specifically, the game includes frame 15 that surrounds grid 20, and a plurality of double-sided tiles 25 that cooperate with the frame and grid, as described in detail below. The game also includes an item of chance, such as a pair of dice 30, and at least one puzzle board 35. The game can also include an item to record player scores, such as scorebook 40.

Figure 2A:
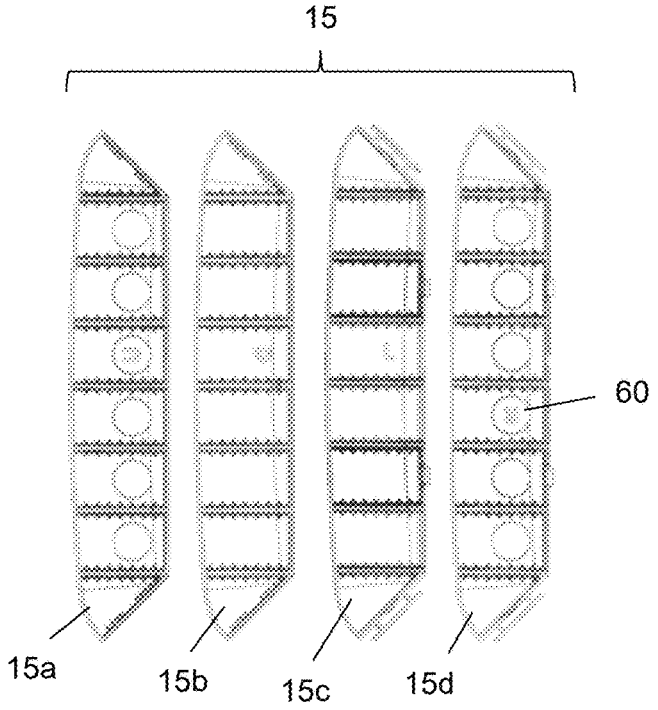
FIG. 2*a* is a bottom plan view of 4 frame legs in accordance with some embodiments of the presently disclosed subject matter.
Figure 2B:
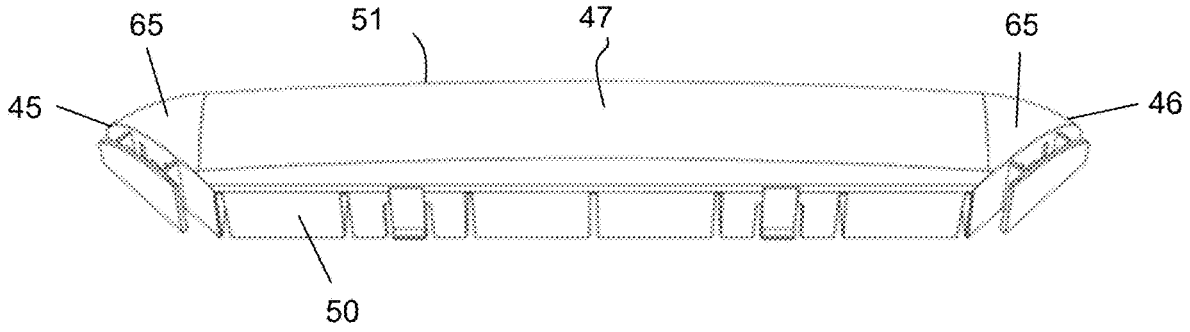
FIG. 2*b* is a top perspective view of a frame leg in accordance with some embodiments of the presently disclosed subject matter.
Figure 2C:
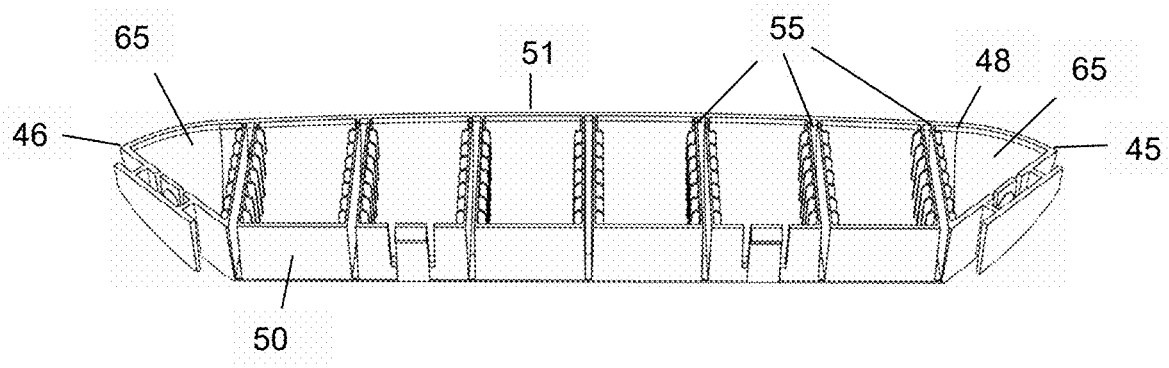
FIG. 2*c* is a bottom perspective view of a frame leg in accordance with some embodiments of the presently disclosed subject matter.

As noted above, game 5 includes frame 15 that surrounds grid 20. The term "frame" broadly refers to a retention structure adapted to accommodate a grid through a central frame opening. Frame 15 can include a plurality of interconnecting units that are releasably attached together. For example, FIG. 2*a* illustrates four frame legs 15*a*, 15*b*, 15*c*, and 15*d*. As shown, the frame legs include two pairs, 15*a* and 15*b* can form the first pair, while 15*c* and 15*d* can form the second pair. Each frame leg includes first end 45 and opposed second end 46, top face 47, and bottom face 48, as shown in FIGS. 2*b* and 2*c*. Each frame leg also includes inner face 50 (facing the grid when the frame is installed) and opposed outer face 51.

As shown in the bottom view of FIG. 2*c*, each frame leg comprises a plurality of channels 55 that extend between the inner and outer faces of the frame legs. Channels 55 function to accommodate the distal ends of the grid when the frame is assembled. The channels can extend uniformly about the length of the channel. Each channel creates a groove through which the grid can be installed or removed, as described in detail below.

In some embodiments, each frame leg can include a unique label 60, allowing for quick and easy assembly. For example, each frame leg can be identified as U, D, L, or R in some embodiments. However, the presently disclosed subject matter is not limited, and any label can be used. Thus, label 60 can be configured as a letter, number, color, symbol, shape, pattern, or combinations thereof. Each leg label can be unique relative to the other legs, allowing a particular frame leg to be easily identified by a user during assembly. In this way, a user can easily determine which leg is attached to which adjacent frame legs, streamlining assembly of the frame.

First and second ends 45, 46 of each frame leg include connection elements that allow the legs to releasably join with adjacent legs. Each connection element can be positioned in wedge 65 on each end of the legs. The wedge shape allows for tight connection between adjacent legs (e.g., no intervening spaces). Thus, the wedges allow the frame to fully fit around the grid, even at the corners.

Figure 3A:
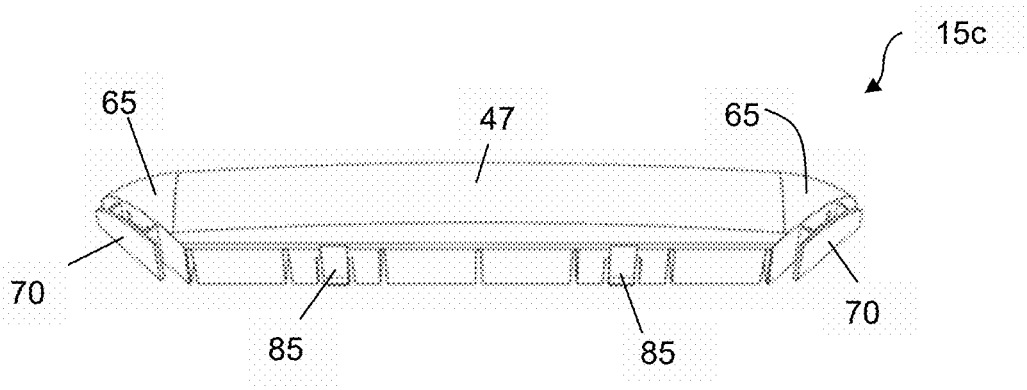
FIGS. 3*a* and 3*b* are top and bottom perspective views, respectively, of a first frame leg in accordance with some embodiments of the presently disclosed subject matter.
Figure 3B:
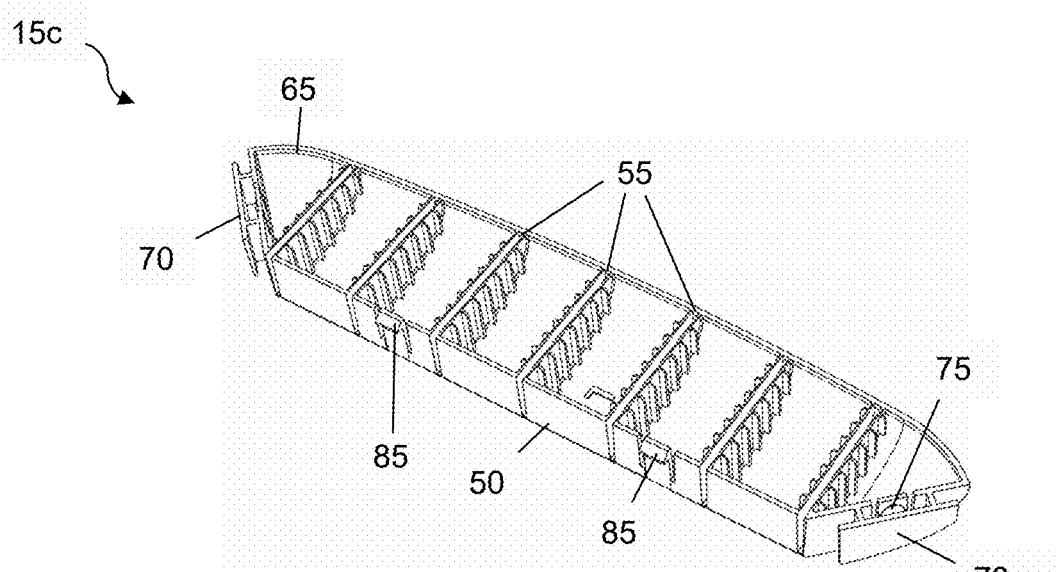
Figure 3C:
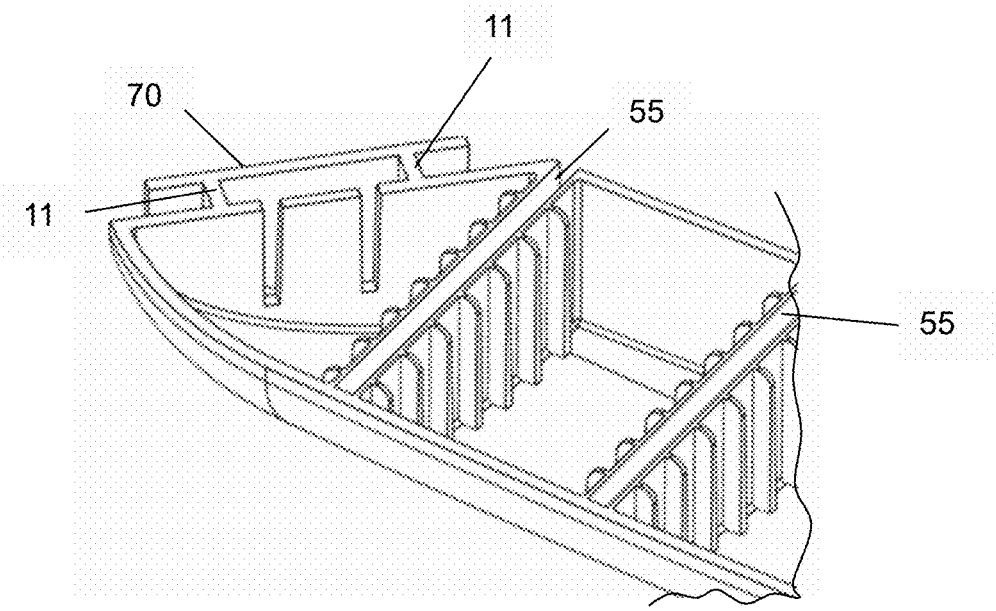
FIG. 3*c* is a fragmentary bottom perspective view showing a connection arm in accordance with some embodiments of the presently disclosed subject matter.

The frame legs are configured as two sets of legs, allowing for secure joining of the legs to create frame 15. Specifically, frame legs 15*c* and 15*d* include connection arms 70 at each end 45, 46 as shown in FIGS. 3*a* and 3*b*. As illustrated the arms extend outward from the wedge, away from the frame via a pair of extensions 11, as shown in FIG. 3*c*. Behind each arm 70 (e.g., on the outer face of the wedge) the wedge includes protrusion 75 that cooperates with a similarly shaped aperture in the wedges of legs 15*a* and 15*b*. For example, each protrusion can be circularly shaped to fit within a circle aperture on the adjacent arms (although any cooperating shapes can be used).

In some embodiments, the arms 70 are angled due to the wedge relative to channels 55 (e.g., at an angle of about 30, 35, 40, 45, 50, 55, or 60 degrees). The angled arms allow the arm to fit over and into the interior of corresponding legs during assembly, ensuring a tight and secure fit.

Figure 4A:
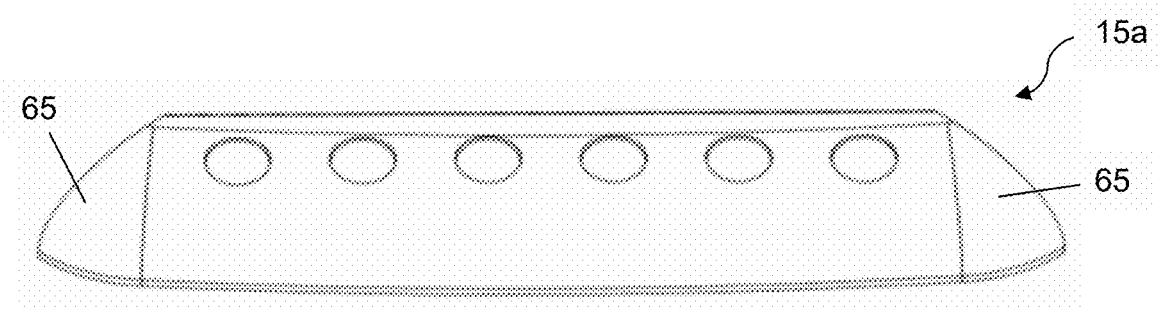
FIG. 4*a* is a top perspective view of a second frame leg in accordance with some embodiments of the presently disclosed subject matter.
Figure 4B:
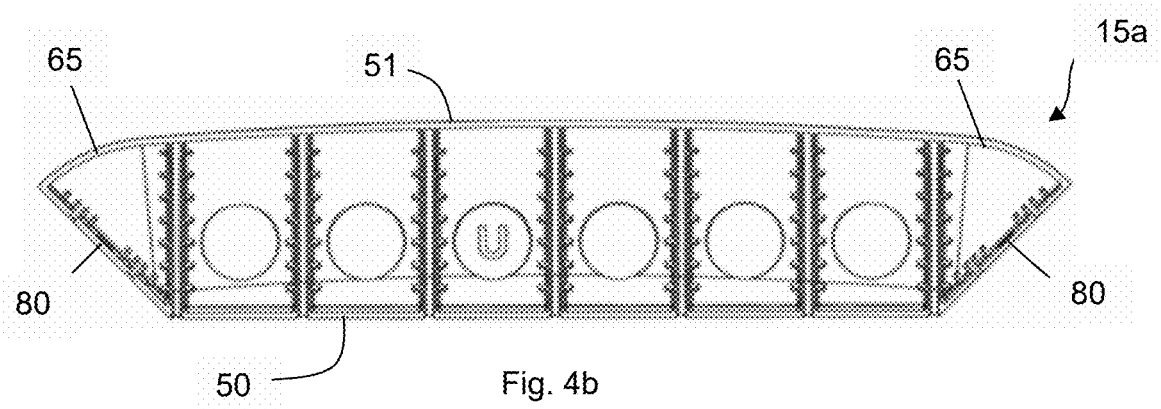
FIGS. 4*b* and 4*c* are bottom perspective views of a second frame leg in accordance with some embodiments of the presently disclosed subject matter.
Figure 4C:
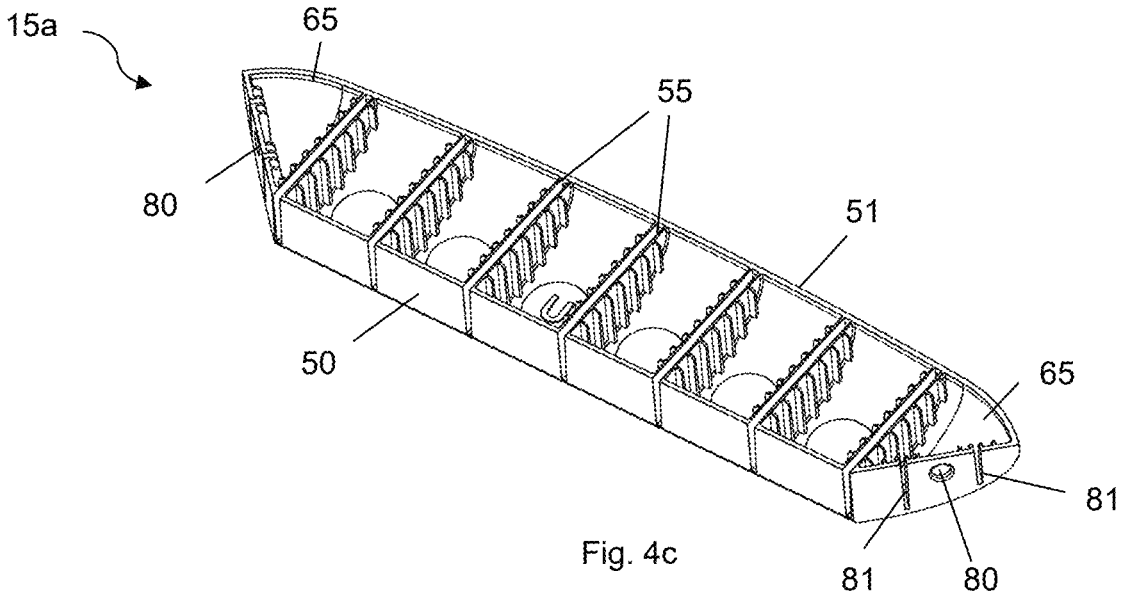
Figure 4D:
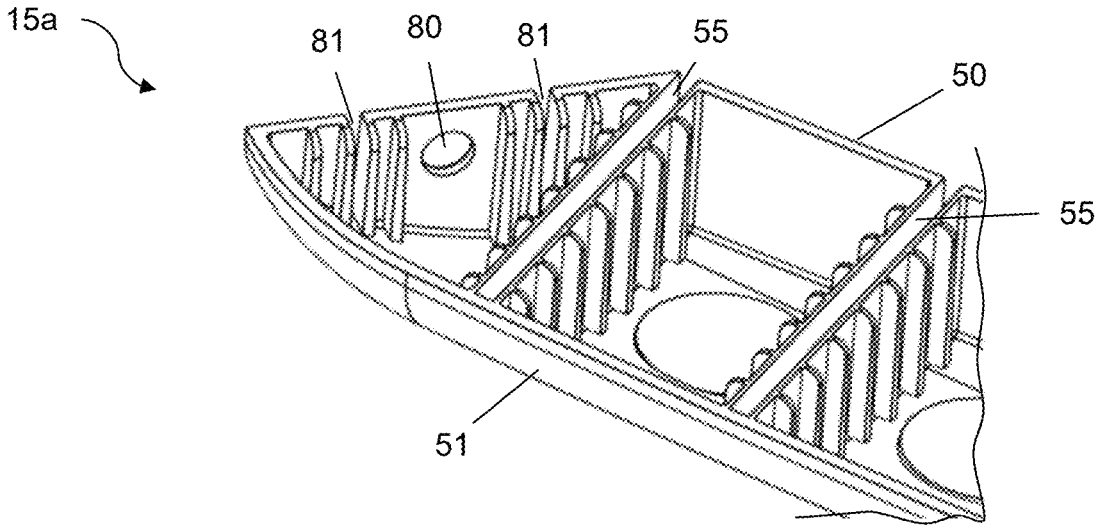
FIG. 4*d* is a fragmentary bottom perspective view of a second frame leg aperture in accordance with some embodiments of the presently disclosed subject matter.

The connection arms 70 of frame legs 15*c* and 15*d* cooperate with receivers 80 positioned in the wedges of frame legs 15*a* and 15*b*, allowing all four frame legs to join together, forming frame 15. As shown in FIGS. 4*a* and 4*b*, the wedges of legs 15*a* and 15*b* includes aperture 80, sized and shaped to receive protrusion 75. As illustrated in FIGS. 4*c* and 4d, the wedges of frame legs 15*a* and 15*b* include cutouts 81 positioned on either side of the aperture. The cutouts receive arm extensions 11 when adjacent frame legs are joined together. In some embodiments, the lengths of the cutouts vary (e.g., a first cutout has a length greater than the length of a second cutout) to accommodate the curvature of wedge 65.

Figure 5:
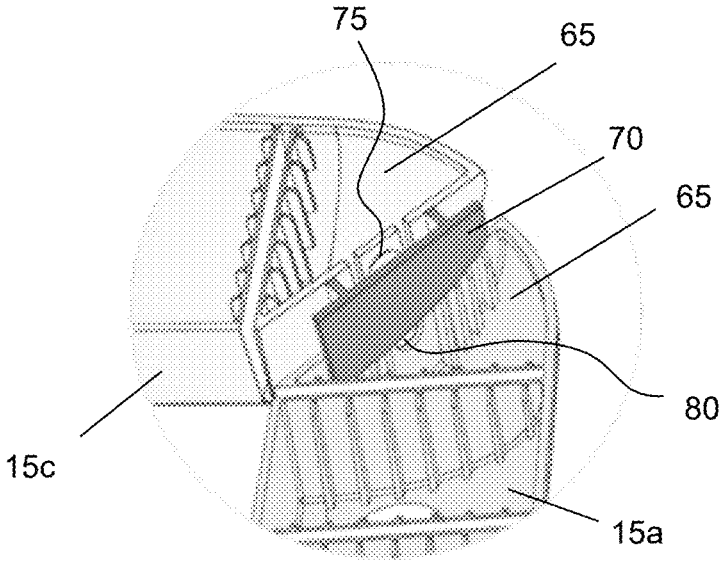
FIG. 5 is a fragmentary bottom perspective view of two adjacent frame legs joined together in accordance with some embodiments of the presently disclosed subject matter.

When joined, arm 70 extends into the interior of the adjacent wedge of an adjoining arm. The arm extension 11 are accommodated by cutouts 81 in the adjacent arm. Aperture 80 is sized and shaped to mate with extension 75. Thus, the extension snaps into the aperture or otherwise is maintained within the aperture and arm 70 is housed within the interior of the adjacent leg via cutouts 81, stabilizing the connection, as shown in FIG. 5. In this way, the connection between two adjacent frame arms cannot be inadvertently dislodged.

Each leg that includes connection arm 70 also includes at least two clips 85 positioned on the inner face 50, as shown in FIGS. 3*a* and 3*b*. The clips function to lock the grid into position, as described in detail below. The term "clip" broadly refers to any type of fastener that can be used to secure the grid to the structural frame.

Figure 6A:
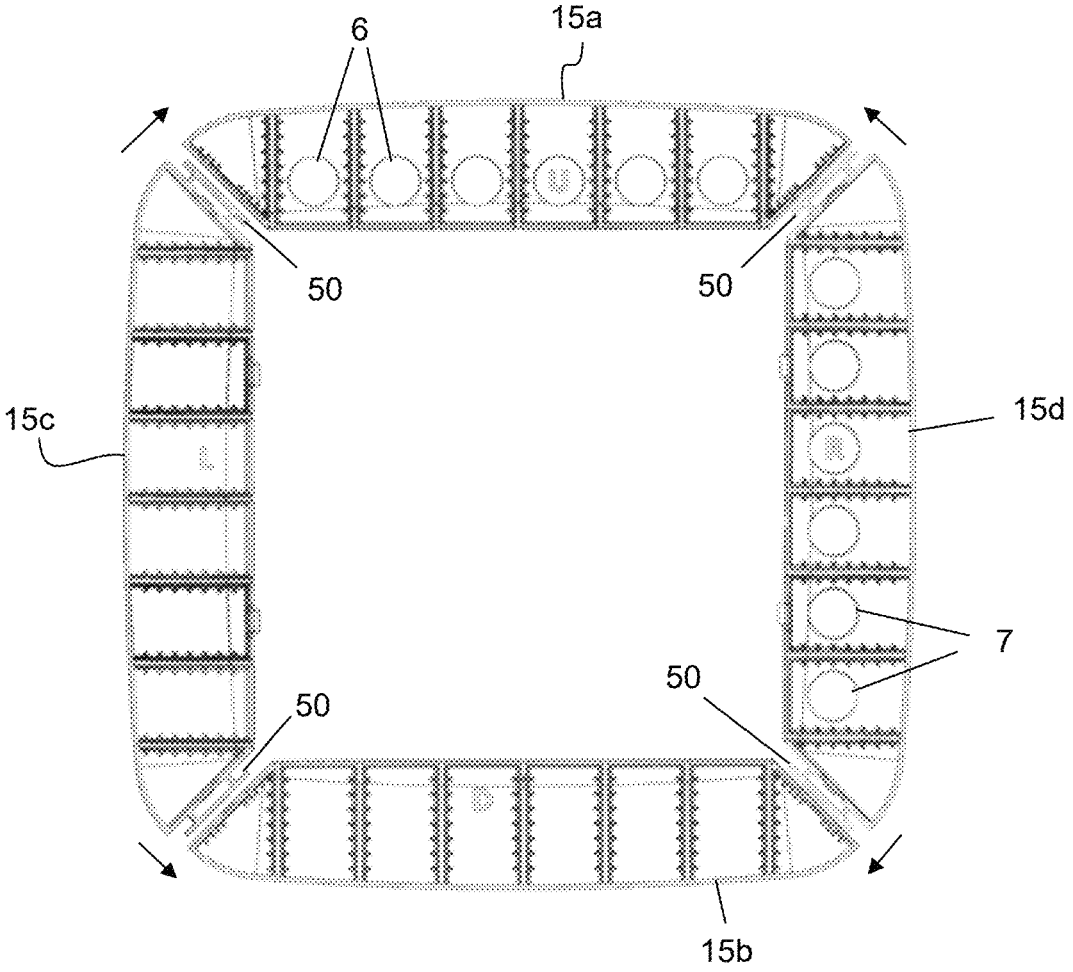
FIG. 6*a* is a bottom plan view of a game frame in accordance with some embodiments of the presently disclosed subject matter.
Figure 6B:
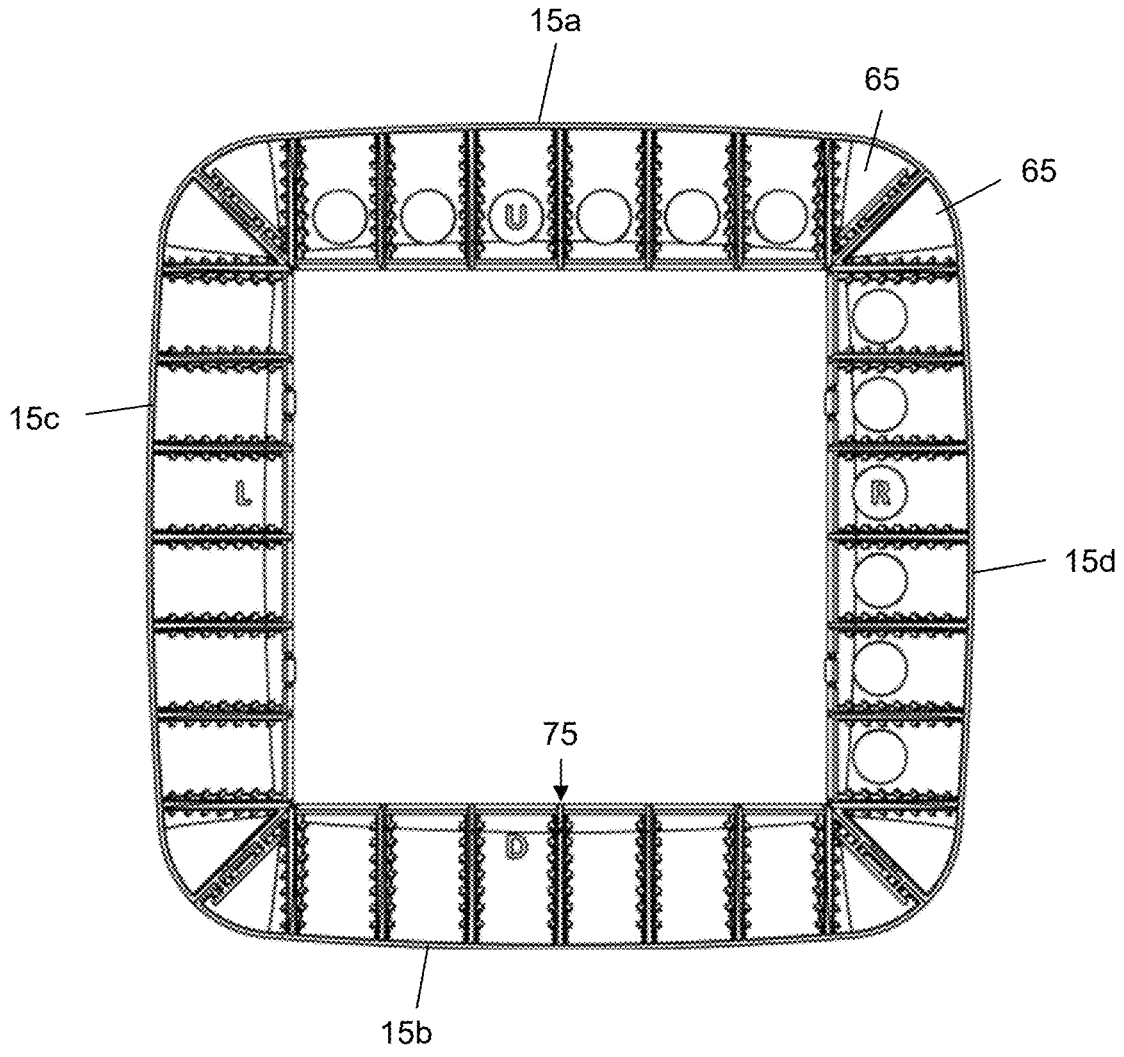
FIG. 6*b* is a bottom plan view of a game frame in accordance with some embodiments of the presently disclosed subject matter.
Figure 6C:
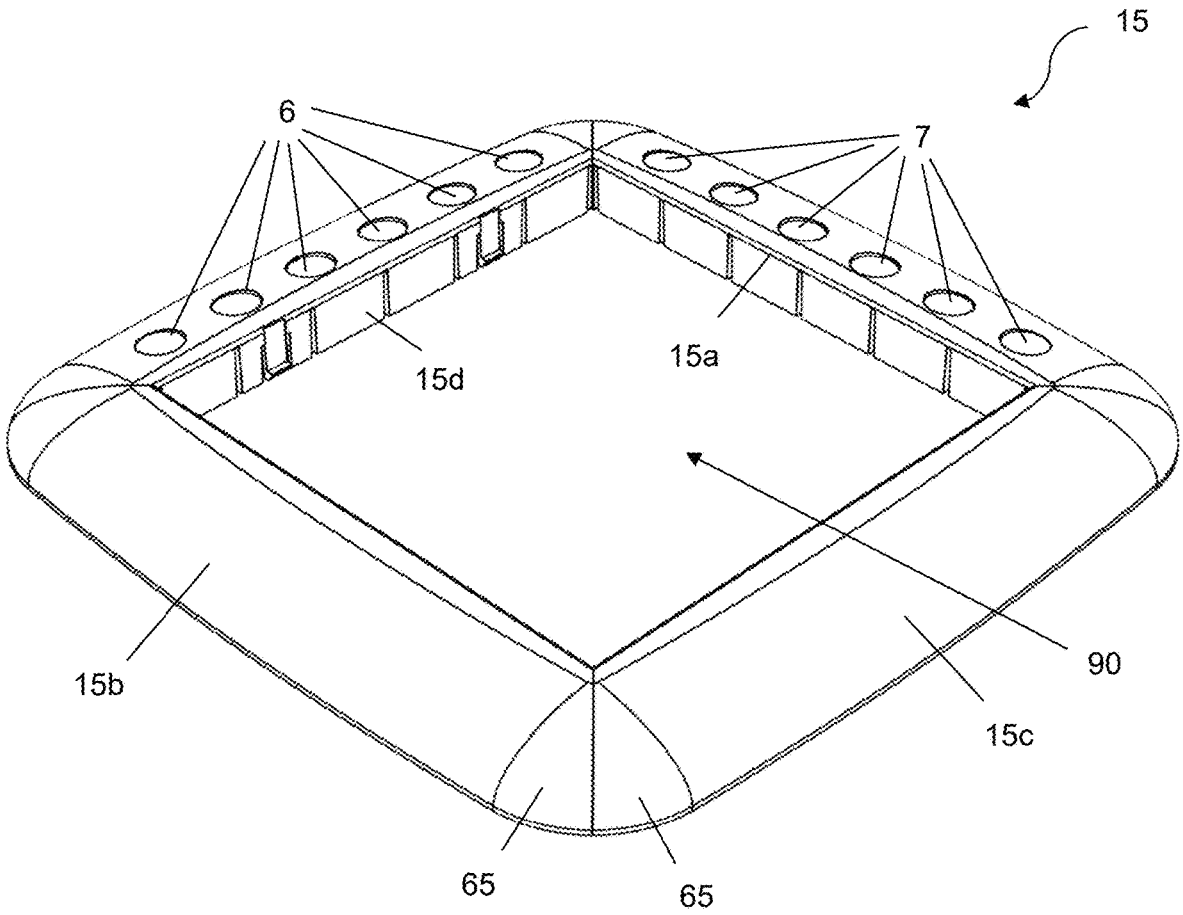
FIG. 6*c* is a top plan view of a game frame in accordance with some embodiments of the presently disclosed subject matter.

The frame pieces are connected to form a single frame member 15 that surrounds grid 20. As shown in FIGS. 6*a*-6*c*, each frame leg can be connected to 2 adjacent frame legs, forming a rectangular or square shape. To releasably attach the frame legs together to form the frame, the corners of adjacent legs are joined together as described above, with open space 90 in the center of the assembled frame.

A line of first and second identifiers 6, 7 are positioned horizontally and vertically on two of the frame legs, as shown in FIG. 6*c*. Each identifier can be unique relative to the other identifiers. For example, first identifiers 6 can be sequential numbers (e.g., 1, 2, 3, 4, 5, 6, etc.) while second identifiers 7 can be sequential letters (A, B, C, D, E, etc.) in some embodiments. The first and second identifiers are used to identify a specific location within the grid as described below. For example, 1A can point to a grid square located at the intersection of row 1, column A. In some embodiments, both identifiers 6, 7 can be numbers but vary in color (e.g., identifiers 6 are blue and identifiers 7 are green).

Figure 7A:
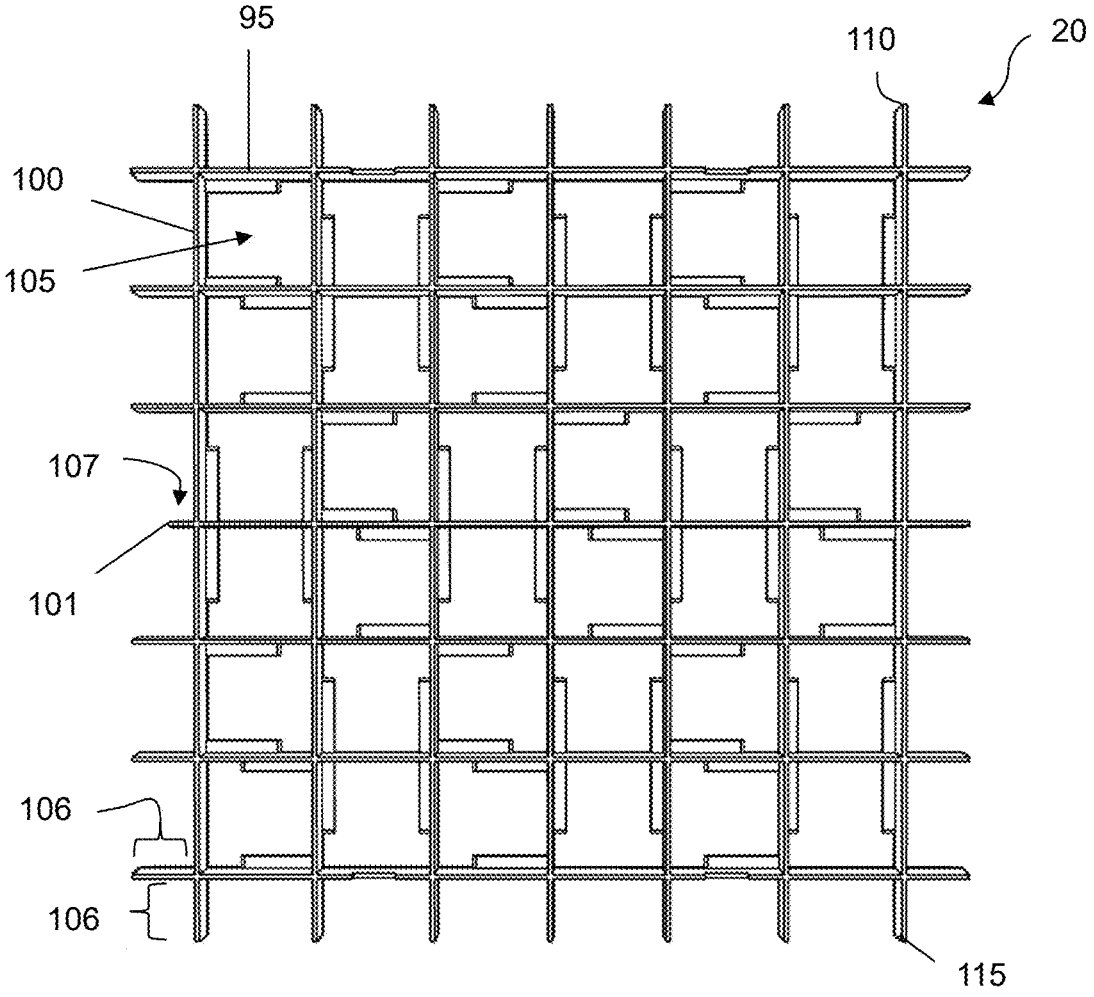
FIG. 7*a* is a top plan view of a game grid in accordance with some embodiments of the presently disclosed subject matter.
Figure 7B:
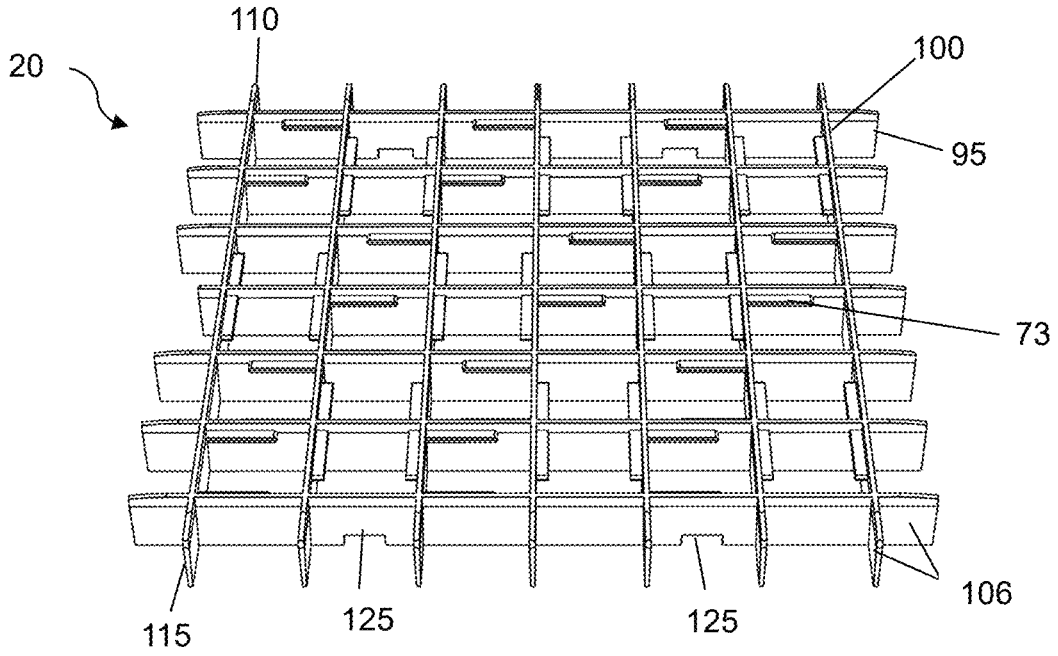
FIG. 7*b* is a perspective view of a game grid in accordance with some embodiments of the presently disclosed subject matter.

Once the frame is assembled, grid 20 is retained within the center of the frame. The term "grid" refers to a network of lines/strips that cross each other to form a series of interconnected squares that define open areas of the grid. One embodiment of grid 20 is illustrated in FIGS. 7*a* and 7*b*. As such, the grid includes a series of intersecting segments 95, 100 that cross perpendicularly to each other to create inner squares 105. One horizontal segment 95 can be parallel to adjacent horizontal segments. Similarly, each vertical segment 100 can be parallel to adjacent vertical segments. Each segment of the grid includes overhang 106 positioned at each end 110, 115 of the segment. Overhang 106 fits into channels 55 positioned within the interior face of the grid when assembled.

In some embodiments, segments 95, 100 intersect at right angles to form 6 columns and 6 rows, with 36 squares 105. However, the presently disclosed subject matter is not limited, and the grid can include any number of segments and any number of squares.

Figure 8A:
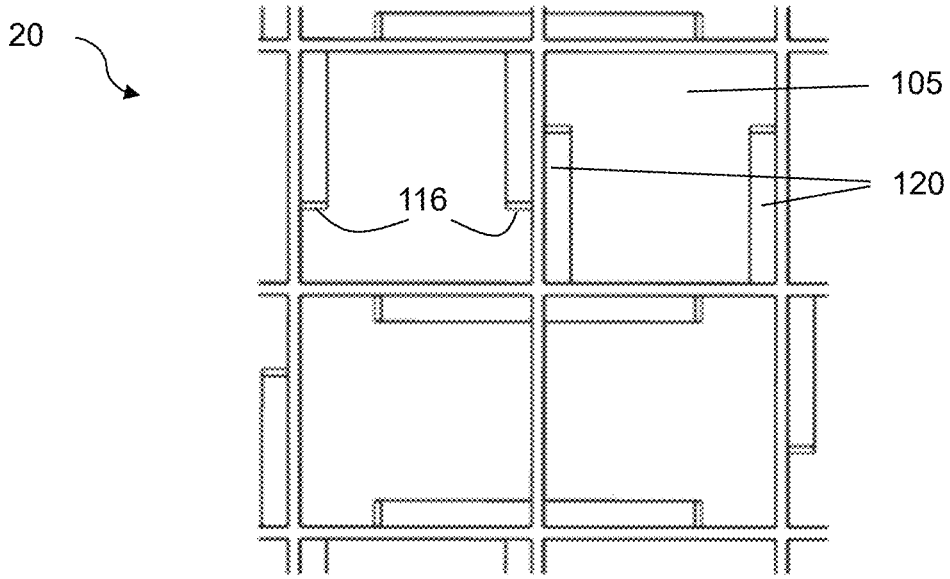
FIG. 8*a* is a top fragmentary view of a game grid in accordance with some embodiments of the presently disclosed subject matter.
Figure 8B:
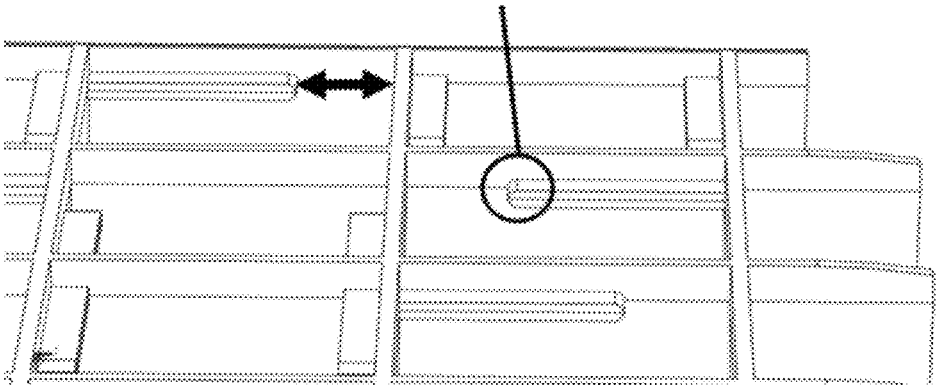
FIG. 8*b* is a fragmentary perspective view of a game grid in accordance with some embodiments of the presently disclosed subject matter.

Each square 105 of the grid includes a pair of tile rails 120 that are configured as a rest to support a corresponding game tile 25. The rails act as a support to provide a stable surface for the tile to rest upon the grid. Each rail is configured adjacent to segments 95 or 100 within the squares to allow the central portion of the square to be accessed by a user during game play. The pattern of the rails allows for removal of the dig tiles. As shown in FIGS. 8*a* and 8*b*, each rail has the precise dimensions and spacing to simultaneously support a tile, while also allowing the tile to fall in when tapped on the correct side (and also leaving the tile in a semi-upright position after falling into square 105 so the player can retrieve it). For example, each rail extends only partially from one segment to the opposed segment. Thus, the rails can extend about 50, 60, 70, or 80 percent along the edge of one square 105. Each rail also includes rounded edge 116 that promotes falling of the tile (e.g., the tile is less likely to be retained on a rounded edge). The length of the gap between the rail and the side of the grid walls and the rounded end of the tile rails are therefore integral and important to game play.

Rails 120 are configured to hold a tile in an elevated position above the surface of a table or support surface. In some embodiments, the distance can be about 1 inch. The rails are integrated into the sides/walls of the dig squares and are positioned on opposing sides/walls of the square, as noted above.

Rails 120 are therefore configured such that each tile 25, after being placed in a square of grid 20, may only be retrieved by tapping on one specific side of the tile by using the player's finger and/or using a separate apparatus designed for this purpose, such as a miniature plastic pickaxe. Tapping on the correct side of the Dig Tile will cause it to simultaneously fall into the center of the dig square, and also be supported in a semi-upright position by rails 120, thereby allowing the player to easily grasp and remove it. Tapping on any of the three incorrect sides of the tile will cause it to maintain its position, thereby thwarting the player's ability to remove it. Thus, the player must find the correct side of tile 25 via trial and error by tapping on the four sides of the tile. This element of gameplay adds challenge, complexity, and additional context to the game as it relates to emulating the process and action of digging something up out of the ground.

The grid also includes a plurality of notches 125 that cooperate with clips 85 of one pair of frame legs to keep the grid in place when the frame is assembled. The notches are therefore positioned adjacent to clips 85 housed within the interior of the frame.

Figure 9:
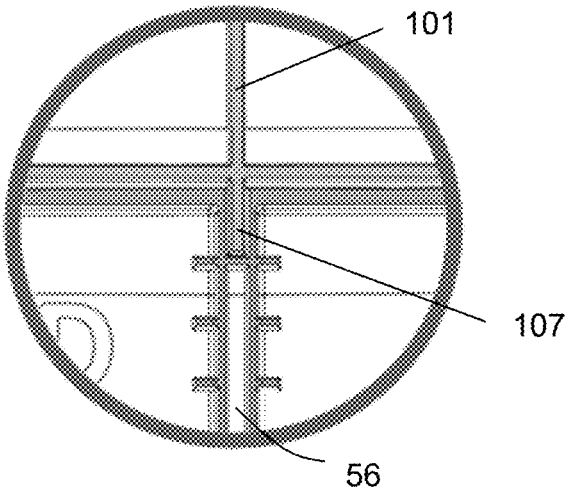
FIG. 9 is a fragmentary bottom plan view of a grid and frame channel assembly in accordance with some embodiments of the presently disclosed subject matter.

One segment 101 of the grid comprises a length that is shorter than the remaining segments, as shown in FIG. 7*a*. For example, segment 101 can have a length that is about 1, 5, 10, or 15 percent shorter than the remaining segments. Thus, one overhang 107 of segment 101 (e.g., at one end of the segment) is less than the overhang of the remaining segments. Segment 101 functions to properly orient the grid within the frame. Specifically, segment 101 fits into a corresponding frame channel 75 that has been configured to cooperate with segment 101 only (e.g., the channel has a length only to accommodate the shortened length of overhang 107), as shown in FIG. 9. In this way, the frame clips are properly positioned to retain the grid within the frame, and the frame is oriented in the correct way.

Figure 10A:
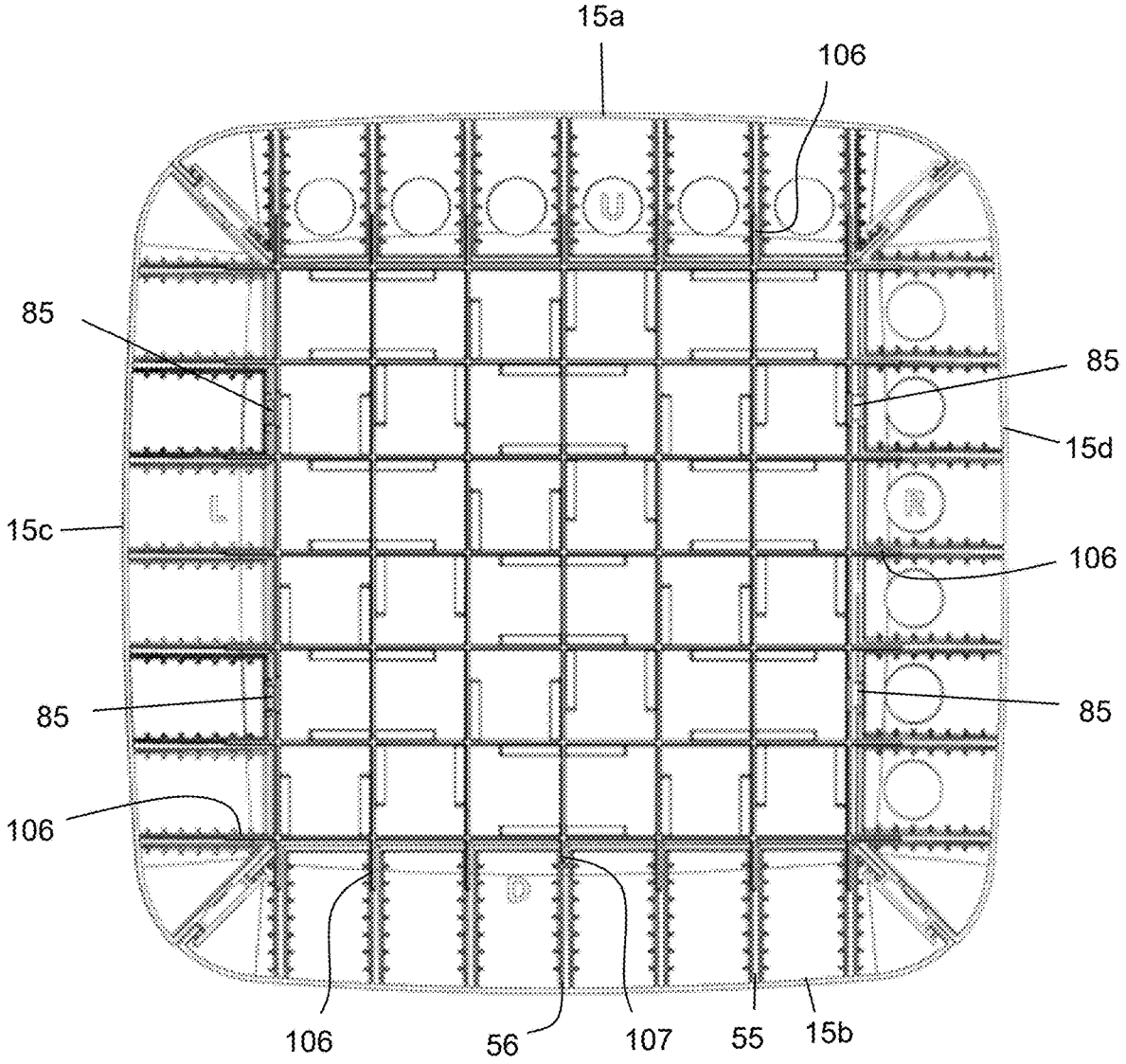
FIG. 10*a* is a bottom plan view of an assembled frame and grid in accordance with some embodiments of the presently disclosed subject matter.
Figure 10B:
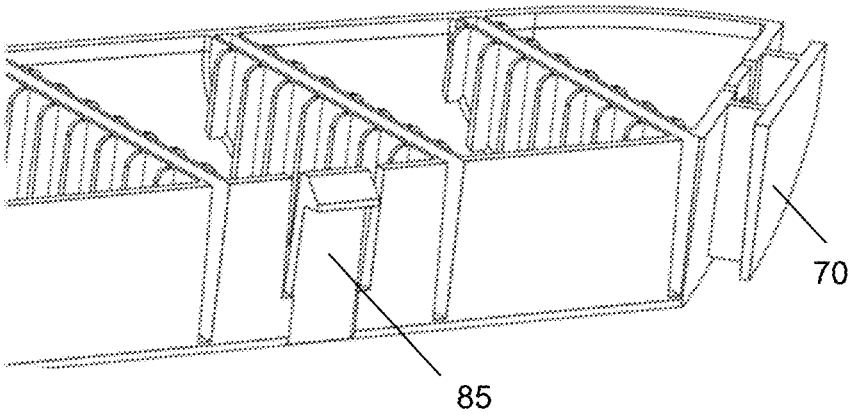
FIG. 10*b* is a perspective view of a frame leg comprising clips in accordance with some embodiments of the presently disclosed subject matter.
Figure 10C:
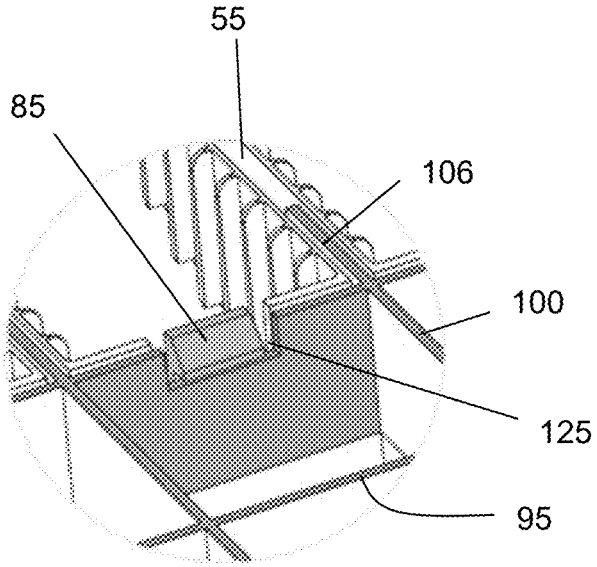
FIG. 10*c* is a perspective view of a frame clipped into a frame in accordance with some embodiments of the presently disclosed subject matter.
Figure 10D:
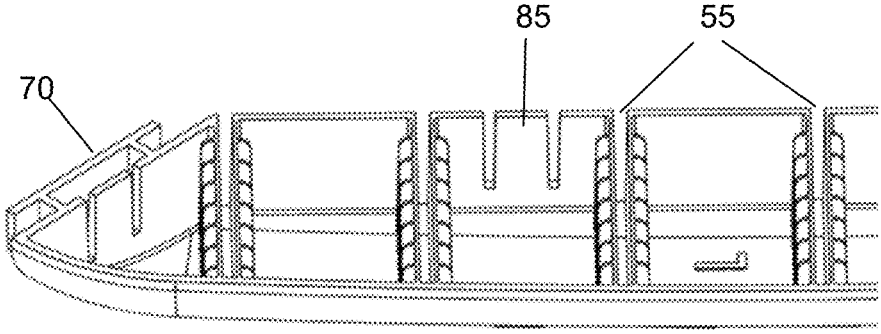
FIG. 10*d* is a rear perspective view of a frame clip in accordance with some embodiments of the presently disclosed subject matter.
Figure 11A:
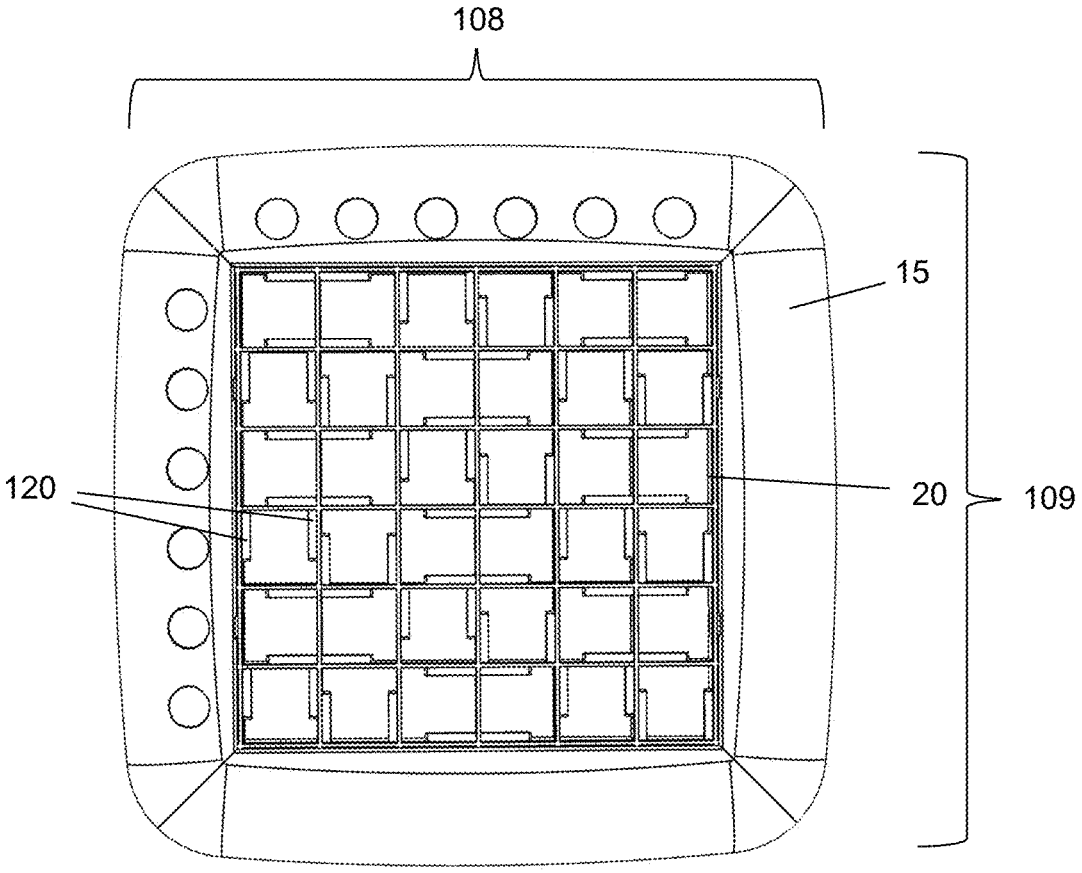
FIG. 11*a* is a top plan view of an assembled frame and grid in accordance with some embodiments of the presently disclosed subject matter.
Figure 11B:
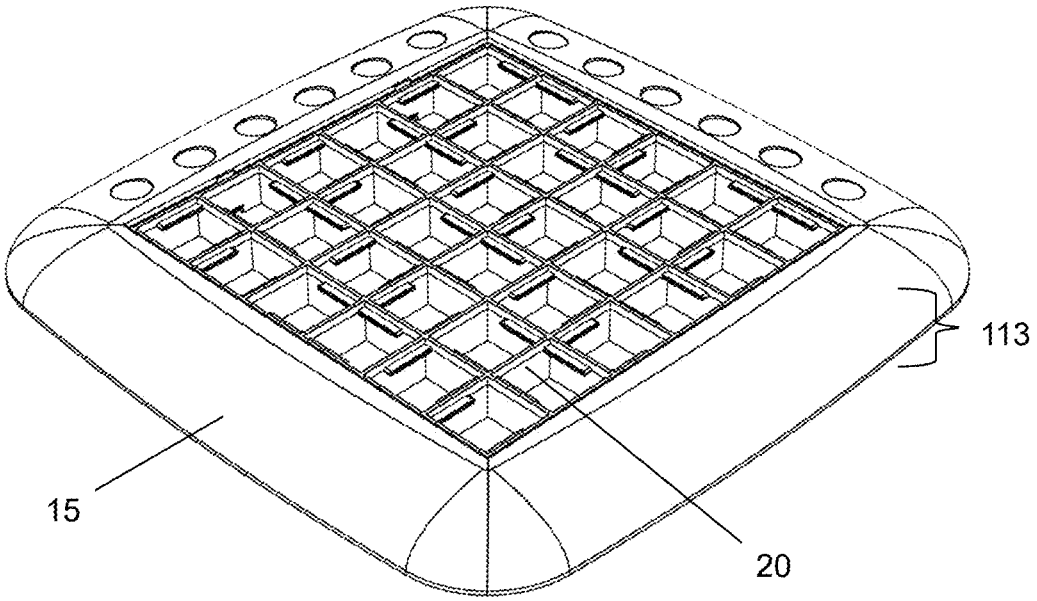
FIG. 11*b* is a perspective view of an assembled frame and grid in accordance with some embodiments of the presently disclosed subject matter.

When the grid is assembled within frame 15, each segment overhang 106 (or 107 for segment 101) fits into a corresponding channel of the frame, as illustrated in FIG. 10*a*. Frame clips 85 are then advanced to secure the grid in place within the frame at grid notches 125, as shown in FIGS. 10*b*-10*d*. FIGS. 11*a* and 11*b* illustrate top and perspective views of the assembled frame with grid attached.

The frame and grid can be constructed from any suitable material(s), such as (but not limited to) cardboard, plastic, metal, wood, or combinations thereof. The top playing surface of the frame and/or grid can be printed or otherwise include graphical representations, such as numbers, images, words, logos, artwork, and the like.

The assembled frame and grid arrangement is not limited and can be configured in any desired size. For example, the device can have length 108 and width 109 as shown in FIG. 11*a*. The term "length" refers to the longest straight-line horizontal distance of the assembled playing device. The term "width" refers to the longest straight-line vertical distance of the assembled playing device. For example, the device can include length and/or width of about 10-30 inches (e.g., at least/no more than about 10, 15, 20, 25, or 30 inches). It should be appreciated that the dimensions of the assembled playing device are not limited and can be configured to be larger or smaller than the length and width ranges given above.

The playing board can also include thickness 113 as shown in FIG. 11*b*. The term "thickness" refers to the distance between the top and bottom surfaces of the playing device. In some embodiments, thickness 113 can be about 1 inch (e.g., at least/no more than about 0.5, 1, 1.5, 2, or 2.5 inches). However, the presently disclosed subject matter is not limited, and the thickness can be greater or less than the given range.

Although depicted as square or rectangular in shape in the Figures, the assembled game can have any suitable shape, such as (but not limited to) oval, round, triangular, cross-shaped, pentagonal, octagonal, hexagonal, abstract, and the like. It should be noted that any shape can be used.

Figure 12A:
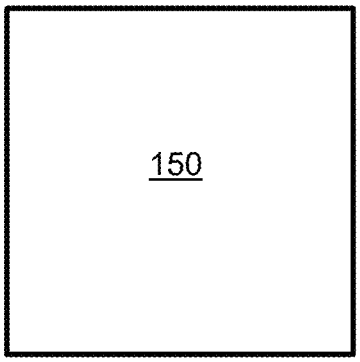
FIG. 12*a* is a top plan view of the bottom layer of a puzzle board in accordance with some embodiments of the presently disclosed subject matter.
Figure 12B:
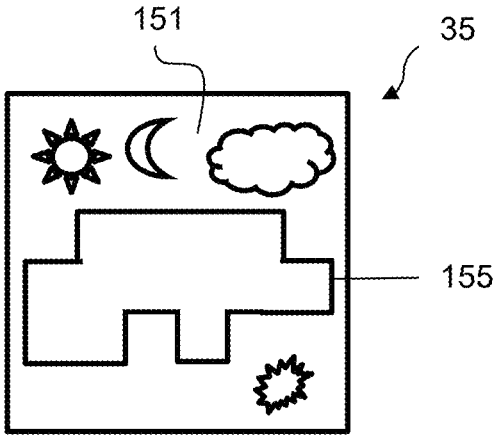
FIG. 12*b* is a top plan view of an assembled puzzle board in accordance with some embodiments of the presently disclosed subject matter.

The game also includes one or more puzzle boards 35. Each puzzle board includes bottom layer 150 (which can be blank as shown in FIG. 12*a*) and top layer 151 adhered to the bottom layer, as shown in FIG. 12*b*. The top and bottom layer can be configured with the same dimensions (length and width) to ensure that they properly overlay each other. The top layer includes a graphic scene (e.g., the image of a dinosaur skeleton set against a background in some embodiments). The top layer includes cut out regions 155 corresponding to a particular shape (e.g., a dinosaur). The cut out regions can be squares that overlay select grid squares 105, resting on a pair of rails, to create the desired shape when the game is assembled. When both layers are adhered together, the resulting puzzle board resembles a frame into which puzzle pieces in the form of tiles 25 are placed.

In some embodiments, multiple puzzle boards 35 are included in the game. In some embodiments, the puzzle boards can have a theme, such as an archaeological dig (e.g., a dinosaur skeleton fossil set against a prehistoric background). However, the puzzle boards are not limited, and any theme or graphic element can be used.

The back side of each puzzle board can depict additional information in some embodiments. For example, when a dinosaur theme is used, the back side can illustrate the living version of the dinosaur and/or one or more facts related to that dinosaur (e.g., name, item that it lived, size, weight, diet). The back side of the puzzle board can also include an image of the tile set used, along with the puzzle board.

Figure 13A:
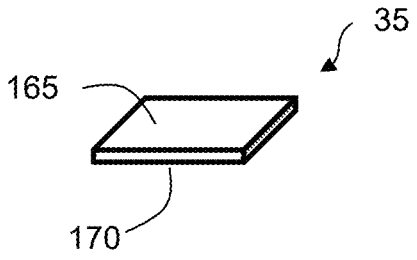
FIG. 13*a* is a perspective view of a game tile in accordance with some embodiments of the presently disclosed subject matter.
Figure 13B:
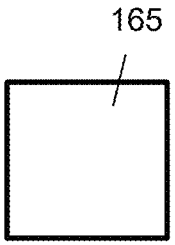
FIG. 13*b* is a top plan view of the first side of a playing tile in accordance with some embodiments of the presently disclosed subject matter.
Figure 13C:
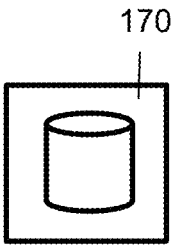
FIG. 13*c* is a bottom plan view of a playing tile in accordance with some embodiments of the presently disclosed subject matter.

The disclosed game can also include a plurality of tiles 25, as shown in FIGS. 13*a*-13*c*. Each tile includes top face 165 and opposed bottom face 170. The top faces of all the tiles include a unform image (e.g., the name of the game) or can be blank. Top face 165 of each tile is face up when the game is assembled so that users cannot view the bottom face.

The tile bottom face can include any of a wide variety of images that have significance in game play. For example, bottom face 170 of each tile can include a bone fossil (used to complete the puzzle board), an impression fossil (plant fossils, footprints, animals, skulls, etc. not used to complete the puzzle board), a mineral (gemstones and minerals not used to complete the puzzle board), an artifact (rings, arrowheads, etc. not used to complete the puzzle board), a bullseye (a stone bullseye with a shovel not used to complete the board), or junk (an item of no value, such as a rusty can, not used to complete the puzzle board).

Figure 14A:
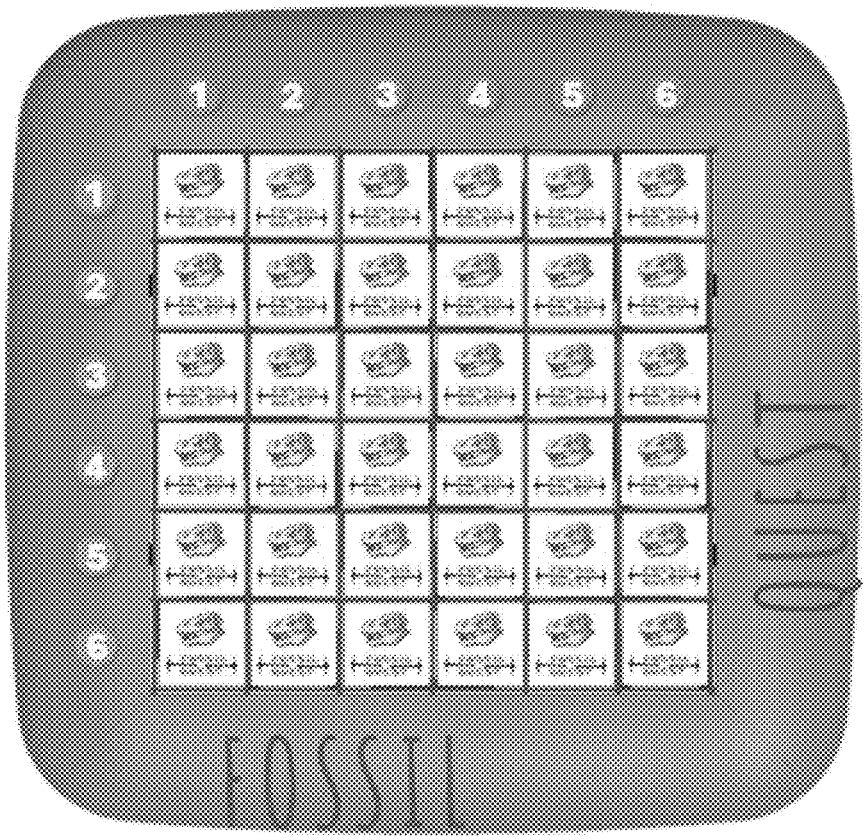
FIG. 14*a* is a top plan view of an assembled frame and grid with a plurality of tiles positioned in accordance with some embodiments of the presently disclosed subject matter.

To play the game, the frame and grid are assembled as described in detail above. At the onset of game play, tiles 25 are randomly placed into squares 105 of grid 20 with the top face exposed so the viewer cannot view the bottom face of the tiles, as shown in FIG. 14*a*. As described above, each tile rests upon a pair of rails. Each dig tile corresponds to a particular puzzle board 35. Thus, each puzzle board has its own unique set of tiles 25. The number of tiles corresponds to the number of squares in the grid. For example, a 6×6 grid (6 columns and 6 rows) includes 36 tiles. Each player then takes a score card.

Advantageously, the playing board is configured to hold and release the dig tiles consistent with game play. In some embodiments, the game board is configured to be consistent with game play that emulates digging up the earth to search for fossils. However, the theme of the game is not limited.

During game play, players compete to retrieve tiles 25 from the grid by rolling dice to find the special tiles needed to compete each puzzle board. In some embodiments, multiple puzzle boards can be included to provide variety for the players as they play the game.

To begin the game, each player rolls 1 die. The player with the highest roll (player 1) goes first, and then gameplay continues in a clockwise order around the game board in some embodiments.

Figure 14B:
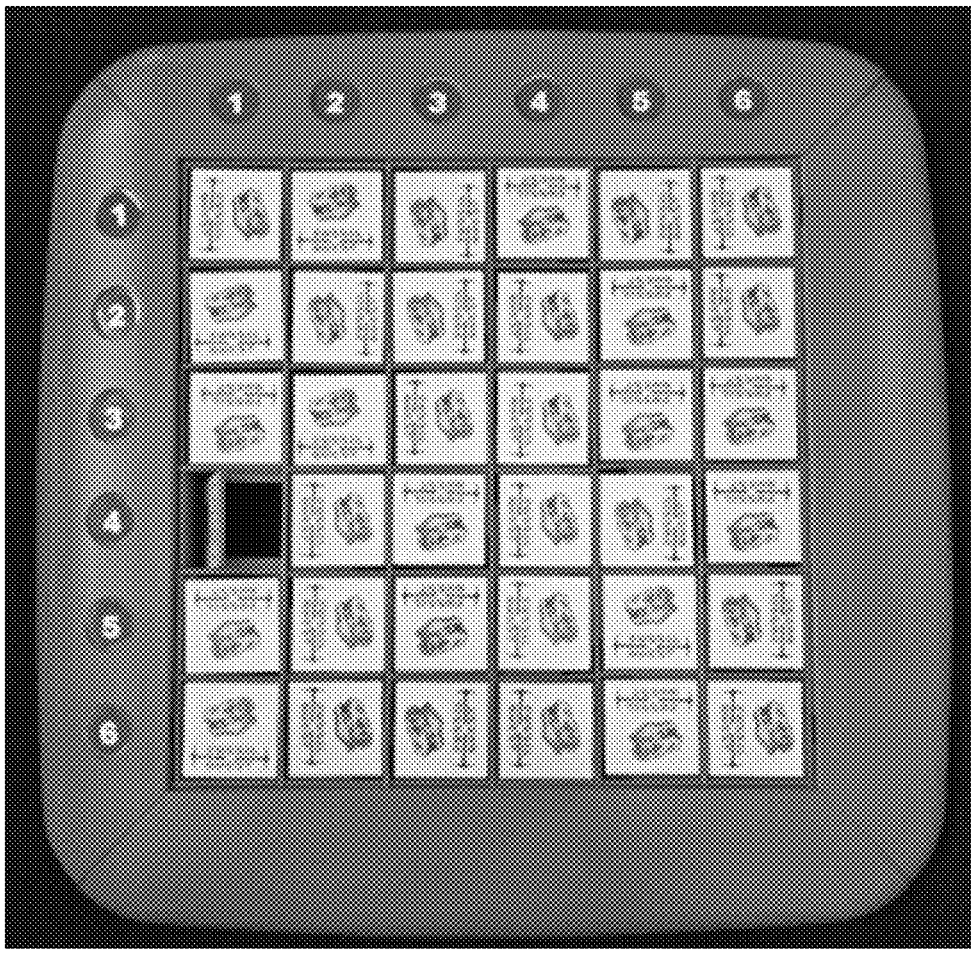
FIG. 14*b* is a top plan view of the assembly of FIG. 13*a* with one tile hit in accordance with some embodiments of the presently disclosed subject matter.
Figure 14C:
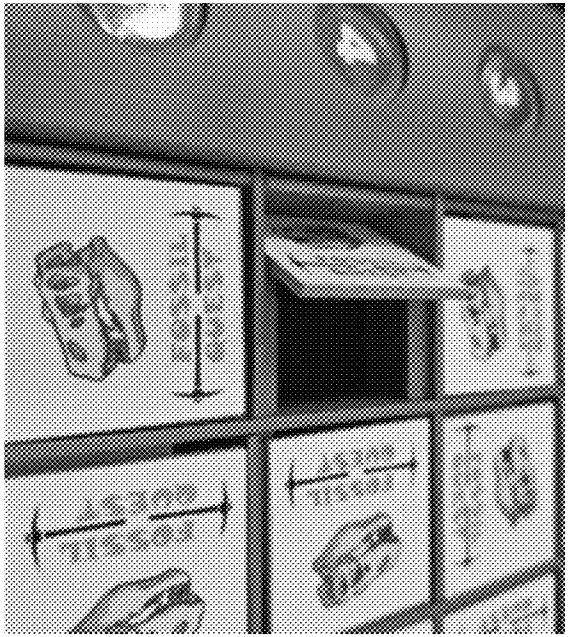
FIG. 14*c* is a fragmentary view of the game assembly with a tile after it has been successfully hit by a player in accordance with some embodiments of the presently disclosed subject matter.

Player 1 rolls both dice and then removes a corresponding tile 25. In some embodiments, players use two differently colored dice, each numbered 1-6, to remove tiles 25 from the grid following a "column & row" grid approach where the "columns" are numbered 1-6 and match the color of 1 die, and the "rows" are numbered 1-6 and match the color of the other die. The numbers and colors correspond to identifiers 6 and 7 as described above. Thus, to determine which tile to remove, the player moves to the tile corresponding to the grid identifiers. For example, if the player rolls a blue 1 and a green 5, the player then moves to the 1 row vertically (green identifiers 6) and the 5 row horizontally (blue identifiers 7). The intersection is the tile to be removed. If there is a dig tile in that square, the player removes the tile (e.g., "digs it up") by tapping the four sides of the tile until one side pops up, allowing the player to remove it, as shown in FIGS. 14*b* and 14*c*. The player's turn then ends. Advantageously, the shape and position of the rails allow a user to remove the tile if tapped at the correct side of the tile (e.g., the tile does not fall within the grid making it difficult or impossible to remove).

If the grid square is empty, the player immediately reverses the order of the two numbers on the grid and removes (e.g., "digs up") the corresponding tile. The player's turn is then over. For example, if a player rolls a green 2 and a blue 6 and that square is empty, they then try blue 2 and green 6.

If both squares are empty, the player's turn is over unless they have a bullseye tile that they wish to use. Bullseye tiles must be saved for future use. If a player is not able to "dig up" a tile because of empty squares, that player may then exchange a Bullseye Tile to "dig up" any tile they choose. There is no limit to the number of Bullseye Tiles that a player can collect, and each Bullseye Tile can only be used once.

If a player rolls doubles (the same number on both dice), they can remove ("dig up") any tile from the grid. When a player removes a tile that is part of the puzzle board on the grid, that tile is then placed on the puzzle board. A player may dig up only 1 tile per turn.

Points are awarded as the players uncover tiles during gameplay. Some tiles include a point value that is added to that player's score card. The player that puts the last tile into the puzzle board is awarded a completion bonus by doubling the point value shown on the final tile.

If the Dig Tile removed by a player contains a point value, the player adds those points to his/her Score Card. If the Dig Tile is part of the Puzzle Board, the player also puts that Tile in the Puzzle Board In some embodiments, the Score Cards used by players to track points comprise a spiral bound flip chart style booklet, including a top cover and bottom cover made of dense cardboard or chipboard in between which are sandwiched three separate sets of "number cards" containing point values, each set of cards representing either hundreds, tens or ones.

To win the game, the player with the most points at the end of the game wins. There are two ways to win the game. For example, the game can end when the puzzle board is completed. Alternatively, the game is declared over when no tiles are removed from the grid for two consecutive turns of all players.

Although the present invention and its advantages have been described in detail, various changes, substitutions, and alterations can be made herein without departing from the spirit and scope of the invention as defined by the appended claims. Moreover, the scope of the present application is not intended to be limited to the embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A game for one or more players, the game comprising:

a frame defined by a plurality of frame legs that interconnect together, creating an open interior, each frame leg comprising a plurality of channels that extend from a front face to a rear face of each frame leg;

a grid defined by a plurality of segments that intersect to create a plurality of squares, wherein each segment includes a first overhang at a first end of the segment and a second overhang at a second end of the segment, each overhang configured to fit within a corresponding channel, and wherein each square includes a pair of opposed rails that partially extend along two opposites sides of each square and wherein each rail includes one rounded end;

a plurality of tiles, each tile comprising a first side and an opposed second side with a unique graphic element;

one or more puzzle boards, each puzzle board comprising one or more spaces configured for the insertion of one or more tiles;

wherein the frame legs are selected from a first pair of frame legs and a second pair of frame legs, wherein each of the first pair of frame legs comprises an arm extending from a first and second end of each of the first pair of frame legs, and wherein each of the first pair of frame legs comprises a protrusion at the first and second ends of each of the first pair of frame legs;

wherein the second pair of frame legs each include cutouts at a first and second end of each of the second pair of frame legs, the cutouts configured to allow insertion of the arm into the cutouts to releasably connect adjacent frame legs together, and wherein each of the second pair of frame legs comprise an aperture at the first and second end of each of the second pair of frame legs, each aperture configured to house a protrusion; and wherein each grid overhang has the same length except one overhang at one end of a segment that is shorter than the remaining overhangs;

wherein each frame channel has the same length except one frame channel that is configured shorter than the remaining channels;

wherein the shorter segment overhang is configured to align with and fit into the shorter frame leg channel.

2. The game of claim 1, further comprising a pair of dice and one or more scorebooks.

3. The game of claim 1, wherein the frame leg channels extend uniformly along a bottom surface length of each frame leg.

4. The game of claim 1, wherein each of the first pair of frame legs comprise one or more clips that cooperate with notches positioned in the grid to join the frame leg and grid together.

5. The game of claim 1, wherein the frame is configured in a rectangular or square shape with an open interior.

6. The game of claim 1, wherein the frame includes horizontal and vertical identifiers that identify each of a plurality of rows and each of a plurality of columns of the grid.

7. The game of claim 1, wherein the grid is configured to fit within the open interior of the assembled frame.

8. The game of claim 1, wherein each tile is sized and shaped to fit into a corresponding grid square.

9. The game of claim 1, wherein the assembled frame has a length and width of about 10-15 inches and a thickness of about 0.5-2 inches.

10. A method of playing the game of claim 1, the method comprising:

assembling the frame legs to form a square or rectangular shape with an open interior;

positioning the grid within the open interior of the assembled frame, wherein each grid segment overhang is accommodated within a frame leg channel;

positioning the plurality of game tiles within the grid, wherein each tile is placed with a first side facing up in a corresponding grid square;

rolling a pair of dice, wherein the numbers rolled on each die correspond to a row and column of grid to identify a target square, whereby a player attempts to remove a tile present in the target square by tapping along one edge of the square such that the square either remains or falls through the square;

when the tile falls through the square, the player retrieves the square and adds it to the corresponding space of the puzzle board.

11. The method of claim 10, wherein the two dice are each a different color relative to each other.

12. The method of claim 10, wherein points are awarded when a tile is removed from a square.

13. The method of claim 1, wherein the player with the most accumulated points at the end of the game is the winner.

14. The method of claim 1, wherein the game ends when the puzzle board is completed by filling in all empty spaces with a corresponding tile to create an image.

15. The method of claim 1, wherein the game ends when no tiles are moved from the grid for two consecutive turns of all players.

* * * * *